US007467983B2

(12) United States Patent
Chien

(10) Patent No.: US 7,467,983 B2
(45) Date of Patent: Dec. 23, 2008

(54) METHOD FOR MANUFACTURING BARRIER RIBS OF A PLASMA DISPLAY PANEL

(75) Inventor: Yu-Ting Chien, Taipei Hsien (TW)

(73) Assignee: Chunghwa Picture Tubes, Ltd., Taipei City (TW)

( * ) Notice: Subject to any disclaimer, the term of this patent is extended or adjusted under 35 U.S.C. 154(b) by 724 days.

(21) Appl. No.: 10/908,190

(22) Filed: May 2, 2005

(65) Prior Publication Data

US 2006/0246808 A1 Nov. 2, 2006

(51) Int. Cl.
*H01J 9/00* (2006.01)

(52) U.S. Cl. ..... 445/24; 445/25; 430/311; 430/320; 430/321

(58) Field of Classification Search ..... 445/24, 445/25; 430/311–321
See application file for complete search history.

(56) References Cited

U.S. PATENT DOCUMENTS 7,060,411 B2 * 6/2006 Mitsui et al. ..... 430/321
7,371,508 B2 * 5/2008 Toyoda et al. ..... 430/321
2003/0077545 A1 * 4/2003 Kawanishi ..... 430/320
2006/0175969 A1 * 8/2006 Bae et al. ..... 313/582
2007/0096652 A1 * 5/2007 Chang et al. ..... 313/586

FOREIGN PATENT DOCUMENTS

CN 1337665 A 2/2002
JP 2002216618 A * 8/2002

* cited by examiner

*Primary Examiner*—Mariceli Santiago
(74) *Attorney, Agent, or Firm*—Winston Hsu

(57) ABSTRACT

A method for manufacturing barrier ribs of a plasma display panel includes providing a substrate, forming a rib material layer on the substrate, forming a patterned photo resist on the rib material layer, and forming a plurality of barrier ribs. Therein, the patterned photo resist includes a plurality of first parallel lines and a plurality of second parallel lines intersecting and perpendicular to the first parallel lines. A thickness of the first parallel lines is thicker than a thickness of the second parallel lines.

24 Claims, 7 Drawing Sheets

24a

24b

24c

24d

24e

24f

METHOD FOR MANUFACTURING BARRIER RIBS OF A PLASMA DISPLAY PANEL

BACKGROUND OF INVENTION

1. Field of the Invention

The present invention relates to a method for manufacturing barrier ribs of a plasma display panel (hereafter referred as PDP), and more particularly, to a method for manufacturing a closed type barrier ribs structure of a PDP which is capable of decreasing the number of process steps.

2. Description of the Prior Art

In general, a PDP is a display device using the visible rays generated when vacuum ultraviolet rays generated by gas discharge excite fluorescent materials. The PDP is thinner and lighter than the cathode ray tubes (CRTs) that have been mainly employed as display devices. Moreover, the PDP has an advantage in that a high definition and large-sized screen can be realized.

For increasing the brightness of a PDP, a closed type barrier ribs structure, which has more area for coating a fluorescent layer, is applied. Please refer to FIG. 1. FIG. 1 is a schematic diagram of a rear substrate 10 of a PDP according to the prior art. As shown in FIG. 1, a closed type barrier ribs structure 12 including a plurality of vertical parallel barrier ribs 14 and a plurality of horizontal parallel barrier ribs 16 are situated on a rear substrate 10 to form a plurality of discharge spaces 18, e.g., discharge cells. A plurality of address electrodes 20 are arranged in parallel with each other and situated underneath the closed type barrier ribs structure 12, and perform address discharge at the location where the address electrodes 20 cross over the sustain electrodes (not shown in FIG. 1). A fluorescent layer 22 that is excited by the vacuum ultraviolet ray generated by a discharge cell and emits visible rays is coated inside the closed type barrier ribs structure 12. A dielectric layer 24 is formed on the rear substrate 10 and the entire surface of the address electrodes 20.

The above rear substrate 10 with the closed type barrier ribs structure 12 has a disadvantage in that it is difficult to perform an exhausting process after the rear substrate 10 and a front substrate (not shown in FIG. 1) are put together by sealing their periphery with the sealing member.

Therefore, a closed type barrier ribs structure including a plurality of vertical parallel barrier ribs and a plurality of horizontal parallel barrier ribs, which are 20 microns lower than the vertical parallel barrier ribs, is developed. This structure has more area for coating a fluorescent layer to increase the brightness of a PDP and reserves sufficient exhausting channels for exhausting. However, a method for manufacturing this structure includes additional process steps of the vertical parallel barrier ribs screen printing to form the height difference between the vertical parallel barrier ribs and the horizontal parallel barrier ribs and the method is more complicated. Furthermore, the alignment of the vertical parallel barrier ribs screen printing is a serious problem.

SUMMARY OF INVENTION

It is therefore an objective of the present invention to provide a method for manufacturing barrier ribs of a plasma display panel for simplifying the manufacture process of a closed type barrier ribs structure, which has sufficient exhausting channels for exhausting.

According to a preferred embodiment of the present invention, a method for manufacturing barrier ribs of a plasma display panel includes providing a substrate, forming a plurality of address electrodes on the substrate, forming a dielectric layer on the address electrodes and the substrate, forming a rib material layer on the dielectric layer, and forming a patterned photo resist on the rib material layer. The patterned photo resist includes a plurality of first parallel lines and a plurality of second parallel lines intersecting and perpendicular to the first parallel lines. A first thickness of the first parallel lines is thicker than a second thickness of the second parallel lines. Then, the method for manufacturing barrier ribs of a plasma display panel further includes forming a plurality of first parallel barrier ribs and a plurality of second parallel barrier ribs, in which a third thickness of the first parallel barrier ribs is thicker than a fourth thickness of the second parallel barrier ribs.

According to another preferred embodiment of the present invention, a method for manufacturing barrier ribs of a plasma display panel includes providing a substrate, forming a plurality of address electrodes on the substrate, forming a dielectric layer on the address electrodes and the substrate, forming a rib material layer on the dielectric layer, and forming a patterned photo resist on the rib material layer. The patterned photo resist comprises a plurality of first parallel lines and a plurality of second parallel lines intersecting and perpendicular to the first parallel lines. A first bonding strength of the first parallel lines is greater than a second bonding strength of the second parallel lines. Then, the method for manufacturing barrier ribs of a plasma display panel further includes forming a plurality of first parallel barrier ribs and a plurality of second parallel barrier ribs, in which a third thickness of the first parallel barrier ribs is thicker than a fourth thickness of the second parallel barrier ribs.

The present invention utilizes a thickness difference or a bonding strength difference between the first parallel lines and the second parallel lines to achieve forming a closed type barrier ribs structure, which has sufficient exhausting channels for exhausting. It is an advantage that the present invention is capable of simplifying the manufacture process of the closed type barrier ribs structure.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
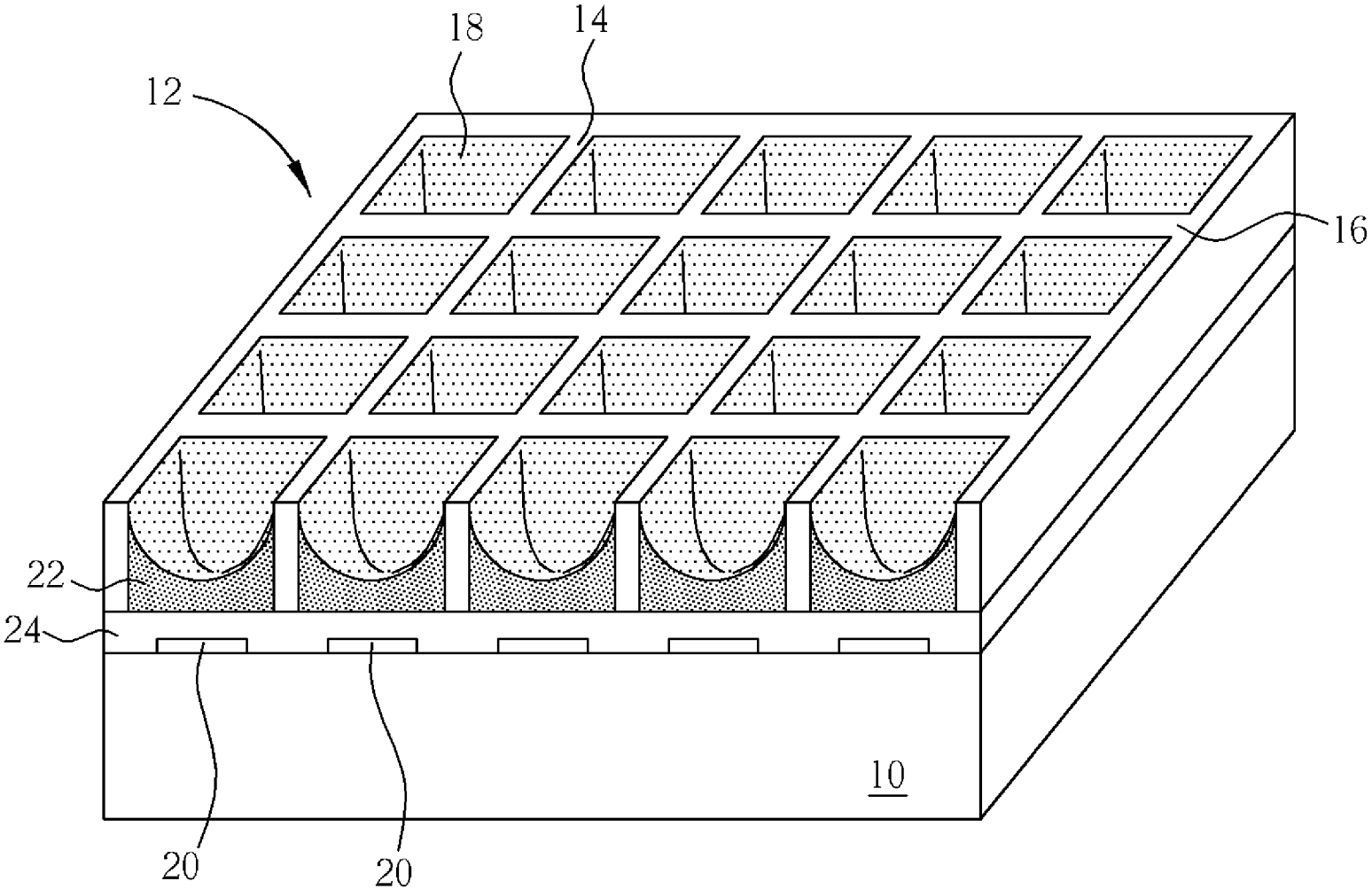
Fig. 1 Prior Art
FIG. 1 is a schematic diagram of a rear substrate of a PDP according to the prior art.
Figure 2:
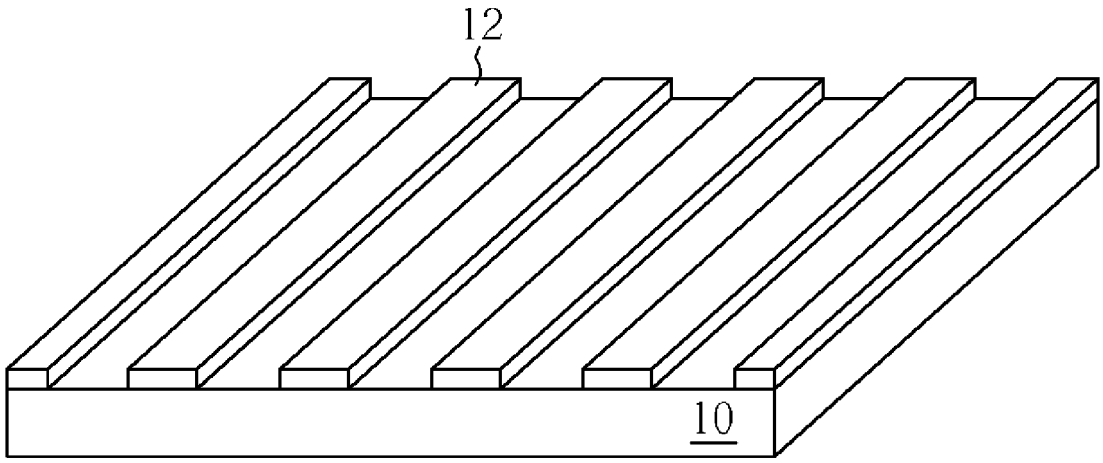
FIG. 2 to FIG. 6 are schematic diagrams for illustrating a method for manufacturing barrier ribs of a plasma display panel according to a first preferred embodiment of the present invention.

Please refer to FIG. 2 to FIG. 6. FIG. 2 to FIG. 6 are schematic diagrams for illustrating a method for manufacturing barrier ribs of a plasma display panel according to a first preferred embodiment of the present invention. As shown in FIG. 2, a substrate 10 is provided. A plurality of address electrodes 12 is formed on the substrate 10.

Figure 3:
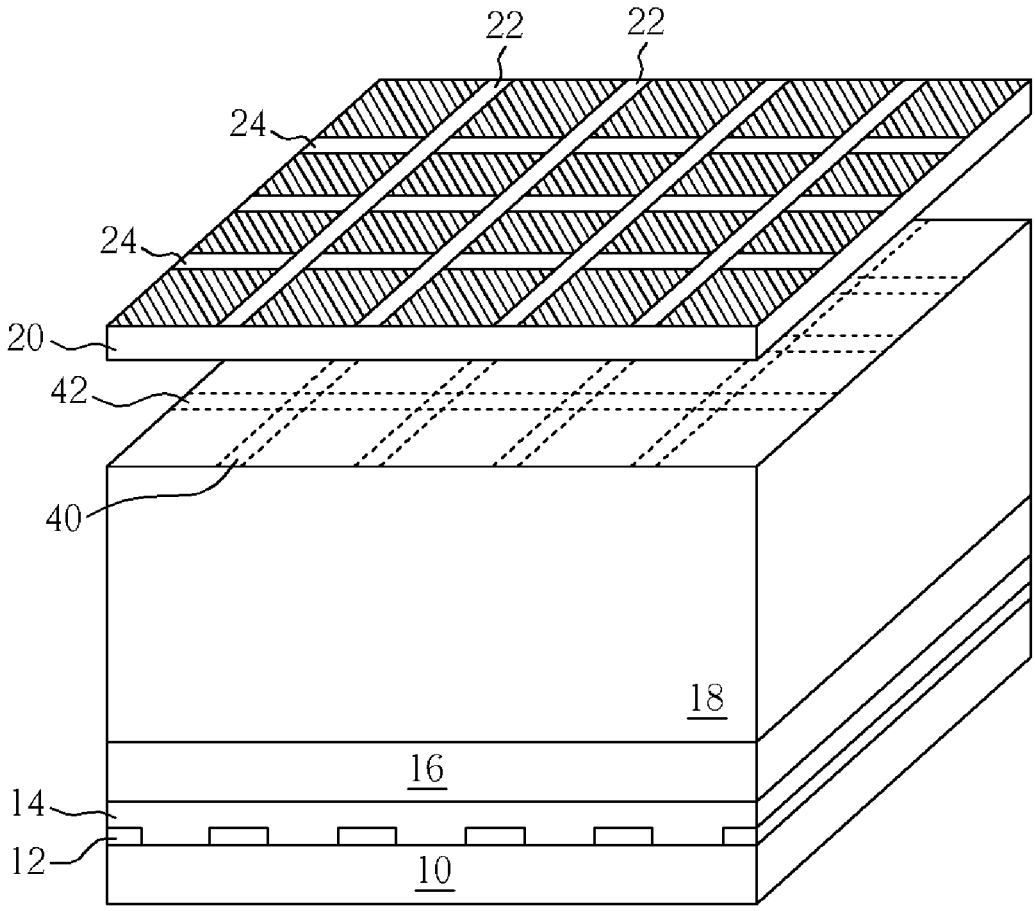

As shown in FIG. 3, a dielectric layer 14 is formed on the substrate 10 and covers the address electrodes 12. A rib material layer 16 is formed on the substrate 10 to cover the dielectric layer 14. A drying process is performed to dry the rib material layer 16. Afterward a photo resist 18 of negative type is coated on the rib material layer 16. A photo mask 20 is utilized to perform an exposure process. The photo mask 20 includes a plurality of pervious to light parallel lines 22 exposing a plurality of corresponding first parallel lines 40 of the photo resist 18 and a plurality of specific regions 24 exposing a plurality of corresponding second parallel lines 42 of the photo resist 18. Therein, the specific regions 24 are not located at a plurality of crossover regions of the first parallel lines 40 and the second parallel lines 42.

Figure 7:
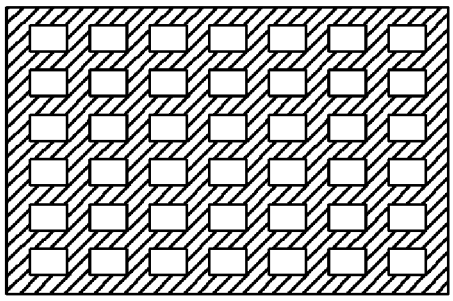
FIG. 7 shows a plurality of patterns that are utilized in the specific regions.
Figure 7:
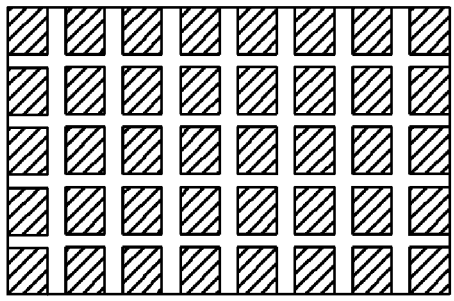
Figure 7:
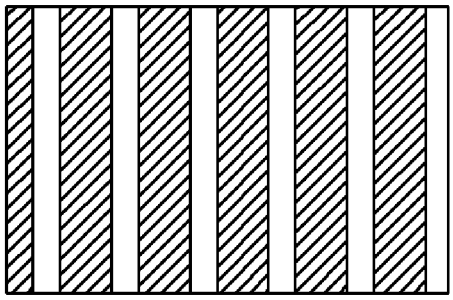
Figure 7:
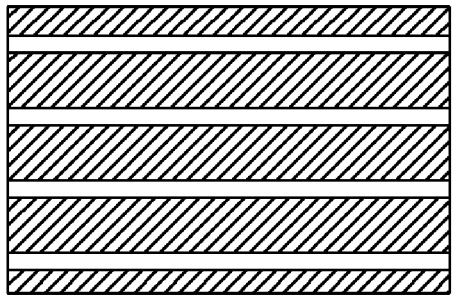
Figure 7:
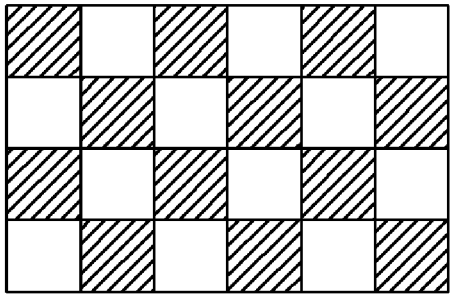
Figure 7:
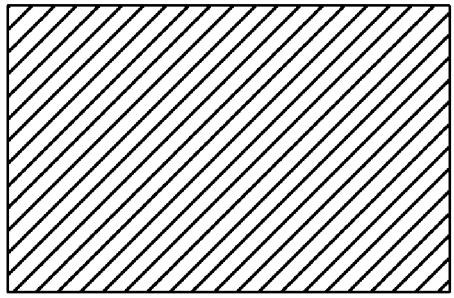

Please refer to FIG. 7. FIG. 7 shows a plurality of patterns that are utilized in the specific regions 24. As shown in FIG. 7, a pattern in each of the specific regions 24 may be selected from a spot array 24*a*, a fence array 24*b*, a vertical slit array 24*c*, a horizontal slit array 24*d*, a mosaic grid array 24*e*, and a halftone region 24*f*.

Please refer to FIG. 3. Light of the exposure process passing through the specific regions 24, which has the pattern of the spot array 24*a*, the fence array 24*b*, the vertical slit array 24*c*, the horizontal slit array 24*d*, or the mosaic grid array 24*e*, is influenced by an interference effect and an exposure energy is reduced, and the light passing through the specific regions 24, which has the pattern of the halftone region 24*f*, is also influenced by the halftone region 24*f* and the exposure energy is reduced. Therefore, a first exposure energy of the exposure process acting on the first parallel lines 40 is more than a second exposure energy of the exposure process acting on the second parallel lines 42. Moreover, the second exposure energy is controlled to be a critical energy, in which the photo resist 18 under the specific regions 24 will not be removed completely in a following development process. The critical energy is determined by photo resist materials, exposure energy volumes, patterns in the specific regions 24, developing time of the development process, and so forth.

Figure 4:
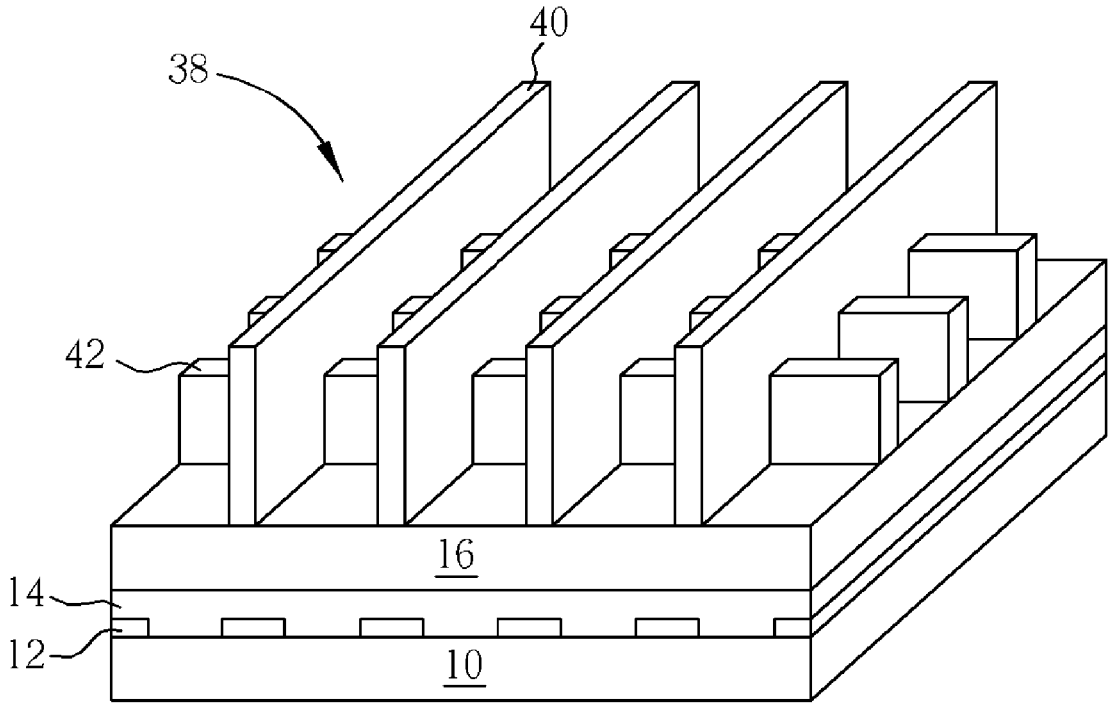

As shown in FIG. 4, a development process is performed to form a patterned photo resist 38 on the rib material layer 16. The patterned photo resist 38 includes the first parallel lines 40 and the second parallel lines 42 intersecting and perpendicular to the first parallel lines 40, and a first thickness of the first parallel lines 40 is thicker than a second thickness of the second parallel lines 42. Therein, the crossover regions of the first parallel lines 40 and the second parallel lines 42 have the first thickness. It is noted that even though the first thickness and the second thickness are the same after the development process in other embodiments, a first bonding strength of the first parallel lines 40 is greater than a second bonding strength of the second parallel lines 42. Therein, the crossover regions of the first parallel lines 40 and the second parallel lines 42 have the first bonding strength.

Figure 5:
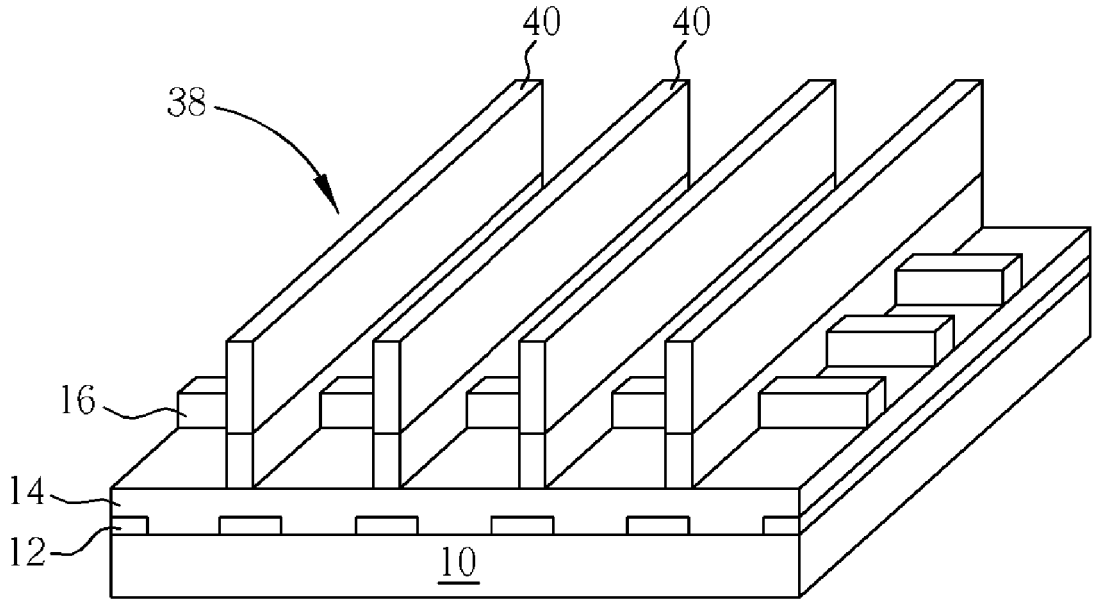

As shown in FIG. 5, the rib material layer 16 that is not covered by the patterned photo resist 38 is removed by an etching process or a sandblasting process. In the same process, a portion of the first parallel lines 40 and all of the second parallel lines 42 are removed, and then a portion of the rib material layer 16 underneath the second parallel lines 42 is removed.

Figure 6:
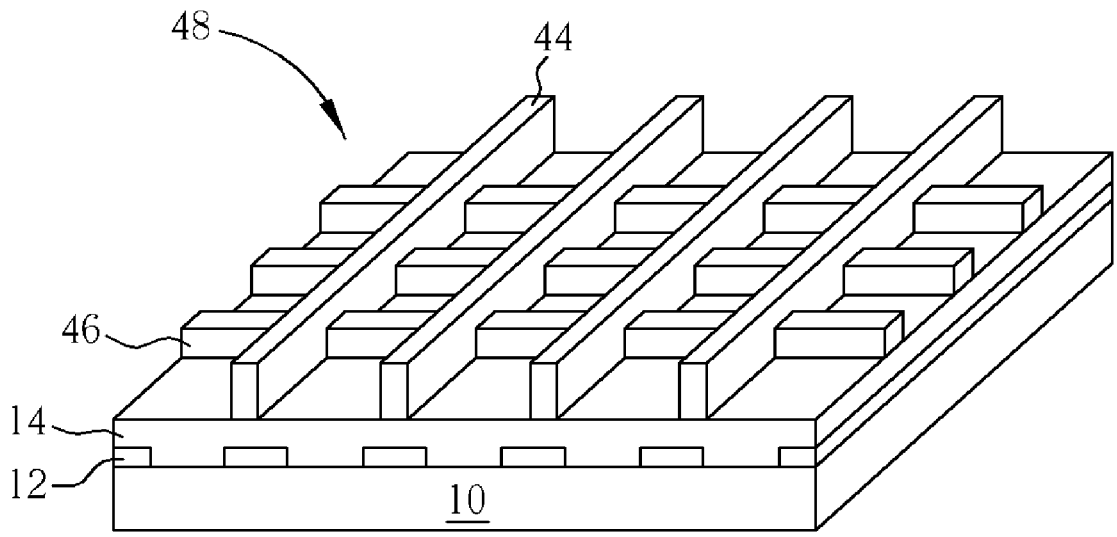

As shown in FIG. 6, the patterned photo resist 38 is removed to form a plurality of barrier ribs on the substrate 10 by a striping process. The barrier ribs include a plurality of vertical parallel barrier ribs 44 and a plurality of horizontal parallel barrier ribs 46, which are intersecting and perpendicular to the vertical parallel barrier ribs 44. A third thickness of the vertical parallel barrier ribs 44 is thicker than a fourth thickness of the horizontal parallel barrier ribs 46. Afterward, a firing process is performed for firing the barrier ribs. Finally, a closed type barrier ribs structure 48 including the vertical parallel barrier ribs 44 and the horizontal parallel barrier ribs 46, which are lower than the vertical parallel barrier ribs, is formed.

In a second preferred embodiment, the photo resist 18 of negative type may change to a photo resist of positive type. If the photo resist of positive type is used, a photo mask including a plurality of shade parallel lines and a plurality of specific regions will be utilized to form a patterned photo resist. The shade parallel lines shade a plurality of corresponding first parallel lines of the photo resist and the specific regions shade a plurality of corresponding second parallel lines of the photo resist. A pattern in each of the specific regions may be selected from a spot array, a fence array, a horizontal slit array, a vertical slit array, a mosaic grid array, and a halftone region. Light of an exposure process passing through the specific regions is reduced such that an exposure energy of the exposure process acting on the second parallel lines is reduced. Therefore, after a development process a thickness of the first parallel lines is thicker than a thickness of the second parallel lines, or a bonding strength of the first parallel lines is greater than a bonding strength of the second parallel lines. The other processes of the second preferred embodiment are similar to the first embodiment.

Compared to the prior art, the present invention utilizes a thickness difference or a bonding strength difference between the first parallel lines and the second parallel lines to achieve forming a closed type barrier ribs structure, which has sufficient exhausting channels for exhausting. It is an advantage that the present invention is capable of simplifying the manufacture process of the closed type barrier ribs structure.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for manufacturing barrier ribs of a plasma display panel, comprising:

providing a substrate;

forming a rib material layer on the substrate;

coating a photo resist of negative type on the rib material layer;

utilizing a first photo mask to perform an exposure process and a development process for forming a patterned photo resist on the rib material layer, wherein the patterned photo resist comprises a plurality of first parallel lines and a plurality of second parallel lines intersecting and perpendicular to the first parallel lines, and a first thickness of the first parallel lines being thicker than a second thickness of the second parallel lines, and the first photo mask comprises a plurality of third parallel lines exposing the corresponding first parallel lines and a plurality of first specific regions exposing the corresponding second parallel lines; and forming a plurality of first parallel barrier ribs and a plurality of second parallel barrier ribs, a third thickness of the first parallel barrier ribs is thicker than a fourth thickness of the second parallel barrier ribs.

2. The method for manufacturing barrier ribs of a plasma display panel of claim 1 further comprising forming a plurality of address electrodes on the substrate and forming a dielectric layer on the address electrodes and the substrate before the rib material layer is formed.

3. The method for manufacturing barrier ribs of a plasma display panel of claim 1 further comprising drying the rib material layer after the rib material layer is formed.

4. The method for manufacturing barrier ribs of a plasma display panel of claim 1, wherein a first exposure energy of the first exposure process acting on the first parallel lines is more than a second exposure energy of the first exposure process acting on the second parallel lines such that the first thickness of the first parallel lines is thicker than the second thickness of the second parallel lines.

5. The method for manufacturing barrier ribs of a plasma display panel of claim 1, wherein a first pattern in each of the first specific regions is selected from a spot array, a fence array, a horizontal slit array, a vertical slit array, a mosaic grid array, and a halftone region.

6. The method for manufacturing barrier ribs of a plasma display panel of claim 1 further comprising following steps for forming the first parallel barrier ribs and second parallel barrier ribs:

removing the rib material layer which is not covered by the patterned photo resist, wherein the second parallel lines are removed and then a portion of the rib material layer underneath the second parallel lines is removed to form the first parallel barrier ribs underneath the first parallel lines and the second parallel barrier ribs underneath the former second parallel lines;

removing the remaining patterned photo resist; and firing the first parallel barrier ribs and the second parallel barrier ribs.

7. The method for manufacturing barrier ribs of a plasma display panel of claim 6, wherein the rib material layer is removed by a sandblasting process.

8. The method for manufacturing barrier ribs of a plasma display panel of claim 6, wherein the rib material layer is removed by an etching process.

9. The method for manufacturing barrier ribs of a plasma display panel of claim 6, wherein the patterned photo resist is removed by a striping process.

10. A method for manufacturing barrier ribs of a plasma display panel, comprising:

providing a substrate;

forming a rib material layer on the substrate;

coating a photo resist of negative type on the rib material layer;

utilizing a first photo mask to perform an exposure process and a development process for forming a patterned photo resist on the rib material layer, wherein the patterned photo resist comprises a plurality of first parallel lines and a plurality of second parallel lines intersecting and perpendicular to the first parallel lines, and a first bonding strength of the first parallel lines being greater than a second bonding strength of the second parallel lines, and the first photo mask comprises a plurality of third parallel lines exposing the corresponding first parallel lines and a plurality of first specific regions exposing the second parallel lines; and forming a plurality of first parallel barrier ribs and a plurality of second parallel barrier ribs, a third thickness of the first parallel barrier ribs is thicker than a fourth thickness of the second parallel barrier ribs.

11. The method for manufacturing barrier ribs of a plasma display panel of claim 10 further comprising forming a plurality of address electrodes on the substrate and forming a dielectric layer on the address electrodes and the substrate before the rib material layer is formed.

12. The method for manufacturing barrier ribs of a plasma display panel of claim 10 further comprising drying the rib material layer after the rib material layer is formed.

13. The method for manufacturing barrier ribs of a plasma display panel of claim 10, wherein a first exposure energy of the first exposure process acting on the first parallel lines is more than a second exposure energy of the first exposure process acting on the second parallel lines such that the first bonding strength of the first parallel lines is greater than the second bonding strength of the second parallel lines.

14. The method for manufacturing barrier ribs of a plasma display panel of claim 10, wherein a first pattern in each of the first specific regions is selected from a spot array, a fence array, a horizontal slit array, a vertical slit array, a mosaic grid array, and a halftone region.

15. The method for manufacturing barrier ribs of a plasma display panel of claim 10 further comprising following steps for forming the first parallel barrier ribs and the second parallel barrier ribs:

removing the rib material layer which is covered by the patterned photo resist, wherein the second parallel lines are removed and then a portion of the rib material layer underneath the second parallel lines is removed to form the first parallel barrier ribs underneath the first parallel lines and the second parallel barrier ribs underneath the former second parallel lines;

removing the remaining patterned photo resist; and firing the first parallel barrier ribs and the second parallel barrier ribs.

16. The method for manufacturing barrier ribs of a plasma display panel of claim 10, wherein the rib material layer is removed by a sandblasting process.

17. The method for manufacturing barrier ribs of a plasma display panel of claim 10, wherein the rib material layer is removed by an etching process.

18. The method for manufacturing barrier ribs of a plasma display panel of claim 10, wherein the patterned photo resist is removed by a striping process.

19. A method for fabricating barrier ribs of a plasma display panel, comprising:

providing a substrate;

forming a rib material layer on the substrate;

coating a photo resist of positive type on the rib material layer;

utilizing a photo mask to perform an exposure process and development process for forming a patterned photo resist on the rib material layer, wherein the patterned photo resist comprises a plurality of first parallel lines and a plurality of second parallel lines intersecting and perpendicular to the first parallel lines, and a first thickness of the first parallel lines being thicker than a second thickness of the second parallel lines, and the photo mask comprises a plurality of third parallel lines shading the corresponding first parallel lines and a plurality of specific regions shading the corresponding second parallel lines; and forming a plurality of first parallel barrier ribs and a plurality of second parallel barrier ribs, a third thickness of the first parallel barrier ribs is thicker than a fourth thickness of the second parallel barrier ribs.

20. The method of claim 19, wherein an exposure energy of the exposure process acts on the second parallel lines such that the first thickness of the first parallel lines is thicker than the second thickness of the second parallel lines.

21. The method of claim 19, wherein a pattern in each of the specific regions is selected from a spot array, a fence array, a horizontal slit array, a vertical slit array, a mosaic grid array, and a halftone region.

22. A method for fabricating barrier ribs of a plasma display panel, comprising:

providing a substrate;

forming a rib material layer on the substrate;

coating a photo resist of positive type on the rib material layer;

utilizing a photo mask to perform an exposure process and a development process for forming a patterned photo resist on the rib material layer, wherein the patterned photo resist comprises a plurality of first parallel lines and a plurality of second parallel lines intersecting and perpendicular to the first parallel lines, and a first bonding strength of the first parallel lines being greater than a second bonding strength of the second parallel lines, and the photo mask comprises a plurality of third parallel lines exposing the corresponding first parallel lines and a plurality of specific regions exposing the second parallel lines; and forming a plurality of first parallel barrier ribs and a plurality of second parallel barrier ribs, a third thickness of the first parallel barrier ribs is thicker than a fourth thickness of the second parallel barrier ribs.

23. The method of claim 22, wherein an exposure energy of the exposure process acts on the second parallel lines such that the first bonding strength of the first parallel lines is greater than the second bonding strength of the second parallel lines.

24. The method of claim 22, wherein a pattern in each of the specific regions is selected from a spot array, a fence array, a horizontal slit array, a vertical slit array, a mosaic grid array, and a halftone region.

* * * * *